US009284799B2

(12) United States Patent
Reitsma et al.

(10) Patent No.: US 9,284,799 B2
(45) Date of Patent: Mar. 15, 2016

(54) METHOD FOR DRILLING THROUGH NUISANCE HYDROCARBON BEARING FORMATIONS

(75) Inventors: Donald G. Reitsma, Katy, TX (US); Ossama R. Sehsah, Katy, TX (US); Yawan Couturier, Katy, TX (US)

(73) Assignee: Smith International, Inc., Houston, TX (US)

( * ) Notice: Subject to any disclaimer, the term of this patent is extended or adjusted under 35 U.S.C. 154(b) by 844 days.

(21) Appl. No.: 13/108,020

(22) Filed: May 16, 2011

(65) Prior Publication Data

US 2011/0284290 A1 Nov. 24, 2011

Related U.S. Application Data

(60) Provisional application No. 61/346,151, filed on May 19, 2010.

(51) Int. Cl.
*E21B 21/08* (2006.01)
*E21B 44/00* (2006.01)

(52) U.S. Cl.
CPC ..... *E21B 21/08* (2013.01)

(58) Field of Classification Search
CPC .... E21B 21/08; E21B 44/00; E21B 2021/006
USPC ..... 175/38, 48, 24
See application file for complete search history.

(56) References Cited

U.S. PATENT DOCUMENTS

| | | | | |
|---|---|---|---|---|
| 3,362,487 | A * | 1/1968 | Lindsey | 175/38 |
| 3,726,136 | A * | 4/1973 | McKean et al. | 73/152.21 |
| 3,740,739 | A * | 6/1973 | Griffin et al. | 367/83 |
| 4,867,254 | A | 9/1989 | Gavignet | |
| 5,952,569 | A | 9/1999 | Jervis et al. | |
| 6,820,702 | B2 * | 11/2004 | Niedermayr et al. | 175/57 |
| 7,044,237 | B2 * | 5/2006 | Leuchtenberg | 175/48 |
| 7,281,593 | B2 * | 10/2007 | Steiner et al. | 175/71 |
| 7,308,952 | B2 * | 12/2007 | Strazhgorodskiy | 175/65 |
| 7,395,878 | B2 * | 7/2008 | Reitsma et al. | 175/38 |
| 7,562,723 | B2 * | 7/2009 | Reitsma | 175/72 |
| 7,571,644 | B2 * | 8/2009 | Ibrahim et al. | 73/152.55 |
| 7,828,081 | B2 * | 11/2010 | Reitsma | 175/25 |

(Continued)

FOREIGN PATENT DOCUMENTS

| | | | |
|---|---|---|---|
| WO | 2008055188 | A2 | 5/2008 |
| WO | 2008055188 | A3 | 6/2008 |

OTHER PUBLICATIONS

Vadetsky, "Drilling Oil and Gas Wells", Moscow, Nedra, 1985, pp. 255, 256, 262.

(Continued)

*Primary Examiner* — Kenneth L Thompson
*Assistant Examiner* — Michael Wills, III

(57) ABSTRACT

A method for controlling entry of hydrocarbon into a wellbore from a subsurface formation includes determining whether hydrocarbon is entering the wellbore. Whether a rate of hydrocarbon entry into the wellbore is slowing is then determined Control of discharge from the wellbore is then switched from maintaining a selected wellbore pressure to controlling a rate of discharge of fluid from the wellbore to be substantially constant if the hydrocarbon entry rate is slowing. Control of discharge from the wellbore is returned to maintaining the selected wellbore pressure when the hydrocarbon stops entering the wellbore.

15 Claims, 3 Drawing Sheets

(56) References Cited

U.S. PATENT DOCUMENTS

| | | | | |
|---|---|---|---|---|
| 7,836,973 | B2 * | 11/2010 | Belcher et al. | 175/25 |
| 7,908,034 | B2 * | 3/2011 | Gray | 700/282 |
| 8,215,417 | B2 * | 7/2012 | Annaiyappa et al. | 175/24 |
| 8,256,532 | B2 * | 9/2012 | Gray | 175/48 |
| 2003/0168258 | A1 * | 9/2003 | Koederitz | 175/38 |
| 2003/0196804 | A1 | 10/2003 | Riet | |
| 2005/0252688 | A1 | 11/2005 | Head et al. | |
| 2007/0151762 | A1 * | 7/2007 | Reitsma | 175/40 |
| 2007/0227774 | A1 | 10/2007 | Reitsma et al. | |
| 2007/0246263 | A1 * | 10/2007 | Reitsma | 175/38 |
| 2007/0294034 | A1 | 12/2007 | Bratton et al. | |
| 2009/0250264 | A1 | 10/2009 | Dupriest | |
| 2011/0214882 | A1 * | 9/2011 | Santos | 166/373 |

OTHER PUBLICATIONS

Examination Report issued in CA2799752 on Jan. 6, 2014, 2 pages.

Office Action issued in CN201180035232.5 on Aug. 22, 2014, 14 pages.

Office Action issued in CN201180035232.5 on Apr. 24, 2015, 6 pages.

Search Report issued in EP11784128.8 on Jun. 24, 2015, 5 pages.

International Search Report and Written Opinion issued in PCT/US2011/036898 on Dec. 12, 2011, 5 pages.

Decision on Grant issued in RU2012154899 on Jan. 28, 2014, 8 pages.

* cited by examiner

METHOD FOR DRILLING THROUGH NUISANCE HYDROCARBON BEARING FORMATIONS

CROSS-REFERENCE TO RELATED APPLICATIONS

Priority is claimed form U.S. Provisional Application No. 61/346,151 filed on May 19, 2010.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling wellbores through subsurface rock formations. More specifically, the invention relates to techniques for safely drilling wellbores through limited volume hydrocarbon-bearing rock formations using dynamic annular pressure control systems.

2. Background Art

A drilling system and methods usable with the present invention are described in U.S. Pat. No. 7,395,878 issued to Reitsma et al. and incorporated herein by reference. During drilling, particularly in certain offshore formations, small-extent hydrocarbon bearing formations ("nuisance hydrocarbon formations") are encountered. Initially, these hydrocarbon bearing formations may have hydrocarbon pressure in the pore spaces that exceeds the hydrostatic pressure of fluid in the wellbore. However, as hydrocarbon enters the wellbore, such formations lose pressure relatively quickly, because their areal extent is limited. Drilling through such nuisance hydrocarbon requires an optimum method to deplete the hydrocarbon volume and pressure to acceptable levels to continue drilling safely because such nuisance hydrocarbon zones are typically quickly depleted as a result of the release of hydrocarbons into the wellbore. Thus, it is not advisable to increase the density of the drilling fluid, or to use the so-called "Driller's method" of wellbore pressure control, which requires the standpipe pressure (i.e., the drilling fluid pressure as it is pumped into the drill string) to remain constant. The foregoing statements are also applicable to drilling hydrocarbon wells "underbalanced", wherein the wellbore hydrostatic (and hydrodynamic) fluid pressure is maintained below the hydrocarbon fluid pressure in the pore spaces of the hydrocarbon bearing rock formations.

There is a need for a more efficient technique to drill through nuisance hydrocarbon and/or underbalanced drilling.

SUMMARY OF THE INVENTION

A method for controlling entry of hydrocarbon into a wellbore from a subsurface formation according to one aspect of the invention includes determining whether hydrocarbon is entering the wellbore. Whether a rate of hydrocarbon entry into the wellbore is slowing is then determined. Control of discharge from the wellbore is then switched from maintaining a selected wellbore pressure to controlling a rate of discharge of fluid from the wellbore to be substantially constant if the hydrocarbon entry rate is slowing. Control of discharge from the wellbore is returned to maintaining the selected wellbore pressure when the hydrocarbon stops entering the wellbore.

Other aspects and advantages of the invention will be apparent from the following description and the appended claims.

DETAILED DESCRIPTION

Figure 1:
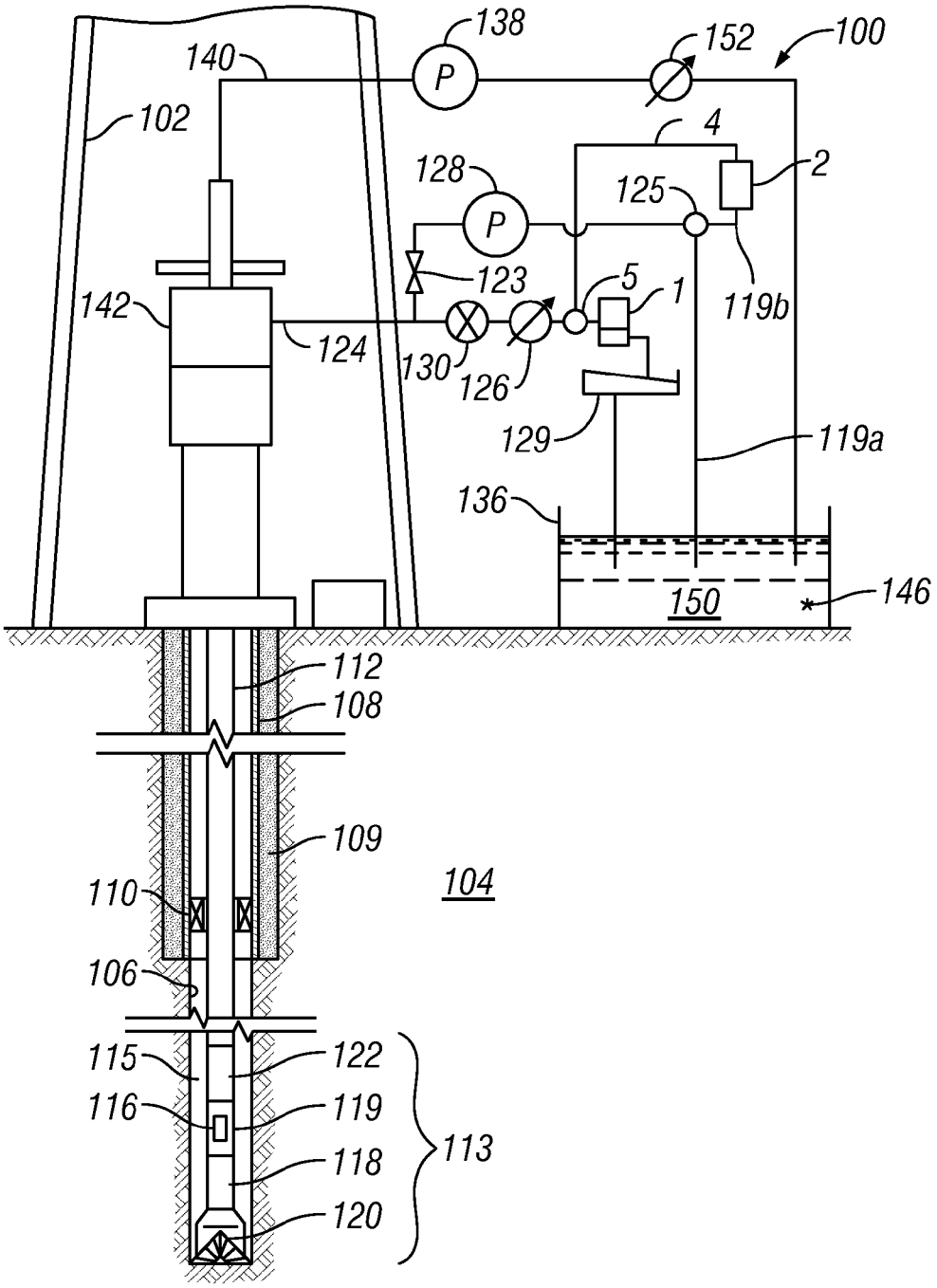
FIG. 1 is an example drilling system using dynamic annular pressure control.

FIG. 1 is a schematic view of a wellbore drilling system having one embodiment of a dynamic annular pressure control (DAPC) system that can be used with some implementations the invention. One such system is described in U.S. Pat. No. 7,395,878 issued to Reitsma et al. and incorporated herein by reference. Various controllers such as a programmable logic controller may be used to automatically operate the various components described below in response to measurements from various sensors described herein, and such controllers are also described in the Reitsma et al. '878 patent. Such components are not shown herein for clarity of the illustrations It will be appreciated that a land based or offshore drilling system may have a DAPC system as shown in FIG. 1 using methods according to the invention. The drilling system 100 is shown including a drilling rig 102 that is used to support drilling operations. Many of the components used on the drilling rig 102, such as the kelly, power tongs, slips, draw works and other equipment are not shown separately in the figures for clarity of the illustration. The rig 102 is used to support a drill string 112 used for drilling a wellbore 106 through subsurface formations such as shown as formation 104. As shown in FIG. 1 the wellbore 106 has already been partially drilled, and a protective pipe or casing 108 has been set and cemented 109 into place in part of the drilled portion of the wellbore 106. In the present embodiment, a casing shutoff mechanism, or downhole deployment valve, 110 is optionally installed in the casing 108 to shut off the annulus and effectively act as a valve to shut off the open hole section of the wellbore 106 (the portion of the borehole 106 below the bottom of the casing 108) when a drill bit 120 at the lower end of the drill string 112 is located above the valve 110.

The drill string 112 supports a bottom hole assembly (BHA) 113 that may include the drill bit 120, an optional mud motor 118, an optional measurement- and logging-while-drilling (MWD/LWD) sensor suite 119 that preferably includes a pressure transducer 116 to determine the annular pressure in the wellbore 106, i.e., the fluid pressure in the annular space 115 between the drill string 112 and the wall of the wellbore 106. The drill string 112 may include a check valve (not shown) to prevent backflow of fluid from the annular space 115 into the interior of the drill string 112 should there be pressure at the surface of the wellbore causing the wellbore pressure to exceed the fluid pressure in the interior of the drill string 112. The MWD/LWD suite 119 preferably includes a telemetry package 122 that is used to transmit pressure data, MWD/LWD sensor data, as well as drilling information to be received at the surface. While FIG. 1 illustrates a BHA 113 utilizing a mud pressure modulation telemetry system, it will be appreciated that other telemetry systems, such as radio frequency (RF), electromagnetic (EM) or drill string transmission systems may be used with the present invention.

The drilling process requires the use of a drilling fluid 150, which is typically stored in a reservoir 136. The reservoir 136 is in fluid communications with one or more rig mud pumps 138 which pump the drilling fluid 150 through a conduit 140. The conduit 140 is connected to the uppermost segment or "joint" of the drill string 112 that passes through a rotating control head or "rotating BOP" 142. A rotating BOP 142, when activated, forces spherically shaped elastomeric sealing elements to rotate upwardly, closing around the drill string 112 and isolating the fluid pressure in the annulus, but still enabling drill string rotation. Commercially available rotating BOPs, such as those manufactured by National Oilwell Varco, 10000 Richmond Avenue, Houston, Tex. 77042 are capable of isolating annular pressures up to 10,000 psi (68947.6 kPa). The fluid 150 is pumped down through an interior passage in the drill string 112 and the BHA 113 and exits through nozzles or jets in the drill bit 120, whereupon the fluid 150 circulates drill cuttings away from the bit 120 and returns the cuttings upwardly through the annular space 115 between the drill string 112 and the borehole 106 and through the annular space formed between the casing 108 and the drill string 112. The fluid 150 ultimately returns to the Earth's surface and is diverted by the rotating BOP 142 through a diverter 117, through a conduit 124 and various surge tanks and telemetry receiver systems (not shown separately).

Thereafter the fluid 150 proceeds to what is generally referred to herein as a backpressure system which may consist of a choke 130, a valve 123 and pump pipes and optional pump as shown at 128. The fluid 150 enters the backpressure system through conduit 124, a choke 130 (explained below) and through an optional flowmeter 126.

The returning fluid 150 flows through a wear resistant, controllable orifice choke 130. It will be appreciated that there exist chokes designed to operate in an environment where the drilling fluid 150 contains substantial drill cuttings and other solids. The choke 130 is preferably one such type and is further capable of operating at variable pressures, variable openings or apertures, and through multiple duty cycles. The fluid 150 exits the choke 130 and flows through the flowmeter 126 (if used) and a valve 5. The fluid 150 can then be processed by an optional degasser 1 and by a series of filters and shaker table 129, designed to remove contaminants, including drill cuttings, from the fluid 150. The fluid 150 is then returned to the reservoir 136.

A flow loop 119*b*, may be provided in advance of a three-way valve 125 for conducting fluid 150 directly to the inlet of the backpressure pump 128. Alternatively, the backpressure pump 128 inlet may be provided with fluid from the reservoir through conduit 119*a*, which is in fluid communication with the trip tank (not shown). The trip tank is normally used on a drilling rig to monitor drilling fluid gains and losses during pipe tripping operations (withdrawing and inserting the full drill string or substantial subset thereof from the borehole). In the invention, the trip tank functionality is preferably maintained. The three-way valve 125 may be used to select loop 119*b*, conduit 119*a* or to isolate the backpressure system. While the backpressure pump 128 is capable of utilizing returned fluid to create a backpressure by selection of flow loop 119*b*, it will be appreciated that the returned fluid could have contaminants that would not have been removed by filter/shaker table 129. In such case, the wear on backpressure pump 128 may be increased. Therefore, the preferred fluid supply for the backpressure pump 128 is conduit 119*a* to provide reconditioned fluid to the inlet of the backpressure pump 128.

In operation, the three-way valve 125 would select either conduit 119*a* or conduit loop 119*b*, and the backpressure pump 128 may be engaged to ensure sufficient flow passes through the upstream side of the choke 130 to be able to maintain backpressure in the annulus 115, even when there is no drilling fluid flow entering the annulus 115. In the present embodiment, the backpressure pump 128 is capable of providing up to approximately 2200 psi (15168.5 kPa) of pressure; though higher pressure capability pumps may be selected at the discretion of the system designer.

The ability to provide backpressure is a significant improvement over normal fluid control systems. The pressure at any axial position in the annulus 115 provided by the fluid is a function of its density and the true vertical depth at the axial position, and is generally approximately a linear function. Additives added to the fluid in reservoir 136 may be pumped downhole to eventually change the pressure gradient applied by the fluid 150.

The system can include a flow meter 152 in conduit 100 to measure the amount of fluid being pumped into the annulus 115. It will be appreciated that by monitoring flow meters 126, 152, and thus the volume pumped by the backpressure pump 128, it is possible to determine the amount of fluid 150 being lost to the formation, or conversely, the amount of formation fluid entering to the borehole 106. Further included in the system is a provision for monitoring borehole pressure conditions and predicting borehole 106 and annulus 115 pressure characteristics.

Figure 2:
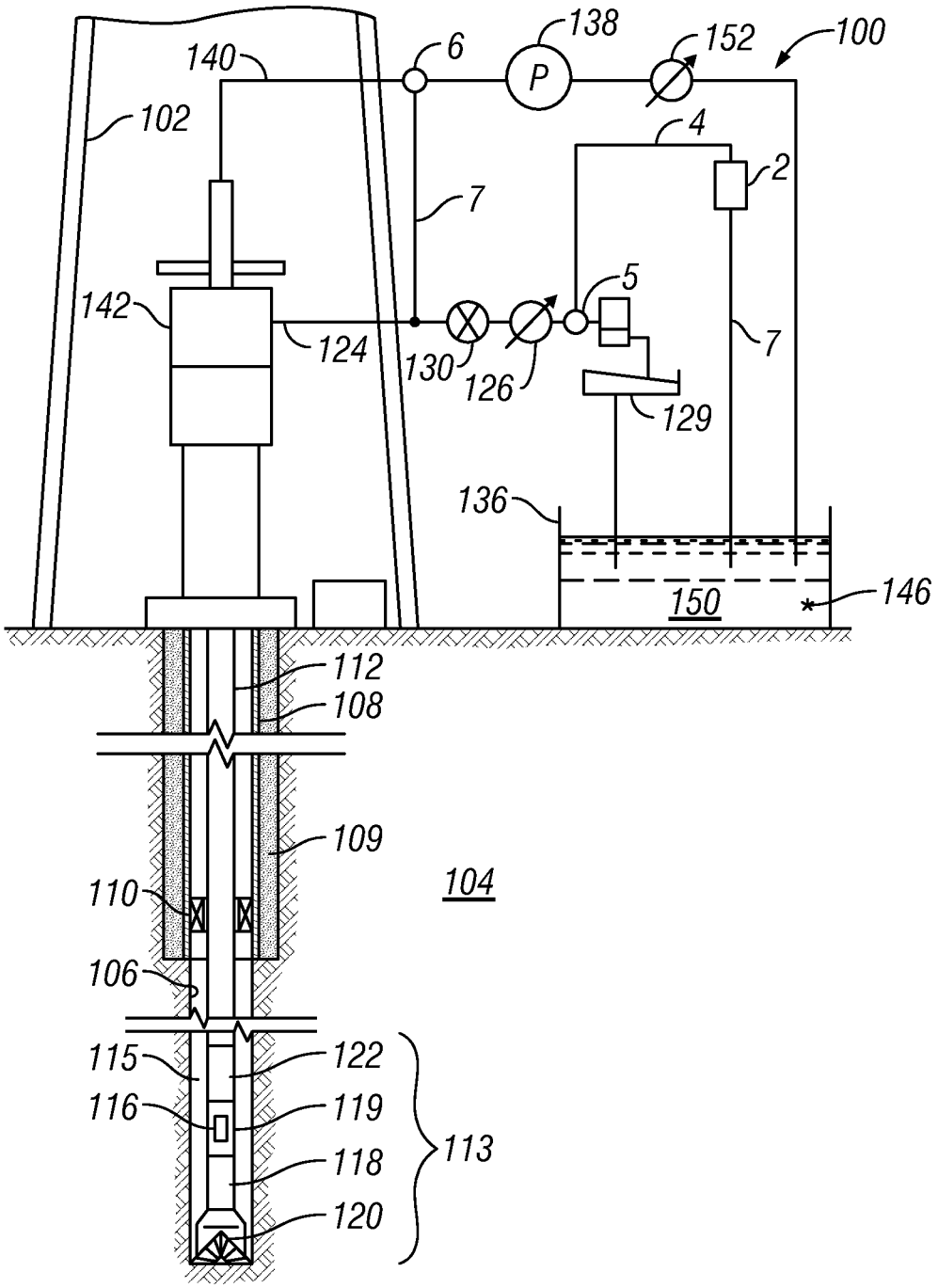
FIG. 2 is an example drilling system using an alternative embodiment of dynamic annular pressure control.

FIG. 2 shows an alternative embodiment of the DAPC system. In this embodiment the backpressure pump is not required to maintain sufficient flow through the choke when the flow through the borehole needs to be shut off for any reason. In this embodiment, an additional three-way valve 6 is placed downstream of the drilling rig mud pumps 138 in conduit 140. This additional three way valve 6 allows fluid from the rig mud pumps 138 to be completely diverted from conduit 140 to conduit 7, thus diverting flow from the rig pumps 138 that would otherwise enter the interior passage of the drill string 112 to the discharge line 124 (and thus applying pressure to the annulus 115). By maintaining action of rig pumps 138 and diverting the pumps' 138 output ultimately to the annulus 115, sufficient flow through the choke 130 to control annulus backpressure is ensured.

It will be appreciated that any embodiment of a system and method according to the invention will typically include a gauge or sensor (146 in both FIGS. 1 and 2) that measures the fluid level in the pit or tank 136. The measured level of fluid in the pit or tank is one input to a method according to the invention. Generally, methods according to the invention use the pit 136 volume gain and/or pit 136 absolute volume as feedback to operate the choke 130 to allow a selected volume of hydrocarbon into the well based on other considerations such as surface pressure and/or casing shoe strength.

When drilling through a so-called "nuisance" formation, the fluid pressure in the formation is at a maximum when fluid entry into the wellbore 106 first occurs but as hydrocarbon is produced into the wellbore 106, the formation pressure and hydrocarbon flow decreases, causing the pit 136 volume to increase initially but then decrease. When such condition is identified, the DAPC system control operates the choke 130 to control the pressure in the well by only allowing a selected amount of fluid to be discharged from the wellbore annulus 115, such that the discharge flow rate remains essentially constant. As the pressure in the nuisance hydrocarbon reservoir decreases, and less hydrocarbon enters the wellbore, the choke 130 is opened will continue to open until such time as it completely open.

Figure 3:
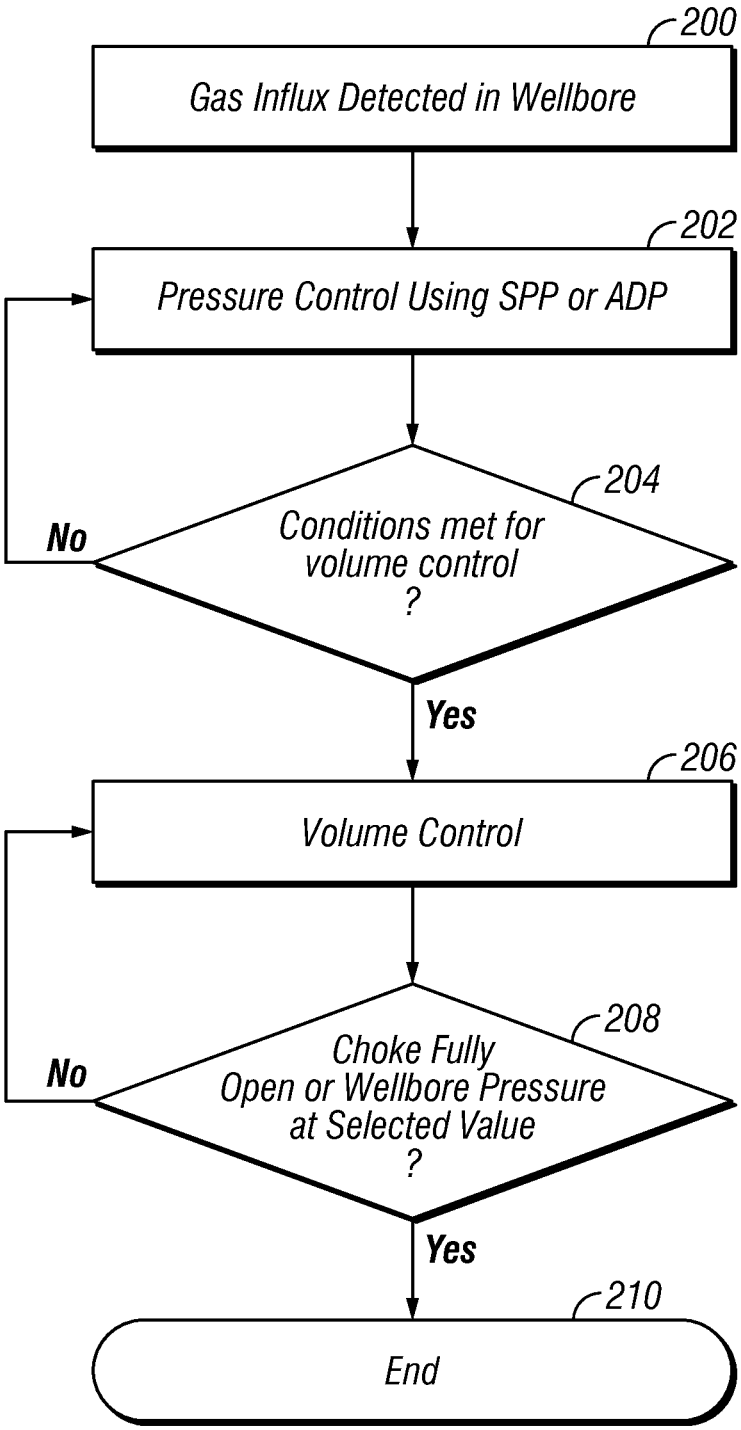
FIG. 3 is a flow chart of an example method according to the invention.

Referring to FIG. 3, a flow chart of an example method according to the invention will be explained. At 200, hydrocarbon influx into the wellbore is detected. Such influx may be detected by detecting an increase in volume or level of fluid in the pit (136 in FIG. 1). At 202, pressure in the annular space and/or in the drill string, called "standpipe pressure" ("SPP") is maintained using the dynamic annular pressure control system (by operating choke 130 in FIG. 1) and by suitable control of the rig pumps (138 in FIG. 1). At 204, it is determined whether conditions have been met to switch operation of the DAPC system to control the pit volume, i.e., by controlling the discharge rate of fluid from the wellbore annulus. The condition or conditions to be met may be that the desired pit gain has been achieved, that the hydrocarbon influx has reached the surface (normally the case), the fluid influx rate is decreasing (rate of increase in pit volume or level is slowing) indicating pressure depletion, hydrocarbon volume is decreasing after the hydrocarbon reaches surface (normally the case), or the pit level is decreasing (normally the case after the hydrocarbon has reached surface). If the condition has not been met at 204, wellbore pressure is maintained using the DAPC system (loop back to 202). Once the condition has been met at 204, the DAPC system switches to pit volume maintenance control at 206.

The maximum pit volume is typically maintained constant, at 206. As the pressure in the reservoir depletes, less hydrocarbon enters the wellbore, which is replaced by the drilling fluid in the annular space, so the pit level begins to decrease. This is inefficient for depleting the hydrocarbon in the reservoir because the hydrostatic pressure in the annulus will increase. In such case, the DAPC system may open the choke (130 in FIG. 1) to reduce the fluid pressure in the well annulus (115 in FIG. 1), thus allowing more hydrocarbon to flow. This in turn causes the pit volume to increase. Opening the choke (130 in FIG. 1) to enable increase hydrocarbon entry is performed until the choke is fully opened or the well is at the desired pressure to continue drilling. This can be observed in the flow chart at 208 as querying whether the choke is fully opened or whether the wellbore pressure is at a selected value. If the foregoing conditions are not met, the process loops back to pit volume control at 206. Once the choke is fully opened, or the selected wellbore pressure has been met, the process ends, and the DAPC system may be switched back to maintaining selected bottom hole (or wellbore annulus) pressure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for controlling entry of fluid into a wellbore from a subsurface formation, comprising:

detecting an increase in volume of drilling fluid stored in a supply/return tank;

determining whether a rate of fluid entry into the wellbore is slowing;

switching control of discharge of fluid from the wellbore from maintaining a selected wellbore pressure to controlling a rate of discharge of fluid from the wellbore to be substantially constant while reducing the wellbore pressure and while the fluid entry rate is slowing; and returning control of discharge of fluid from the wellbore from controlling a rate of discharge of fluid from the wellbore to maintaining the selected wellbore pressure when fluid entering the wellbore is at an acceptable level.

2. The method of claim 1 wherein the controlling wellbore pressure and controlling rate of fluid entry comprises operating a variable orifice choke in a discharge line from the wellbore.

3. The method of claim 1 wherein the determining slowing comprises detecting at least one of constant volume and decreasing volume of drilling fluid stored in the supply/return tank.

4. The method of claim 1 wherein the returning control is performed when a variable orifice choke is substantially completely opened.

5. The method of claim 1 wherein the fluid comprises hydrocarbon.

6. A method, comprising:

measuring either (i) a level of fluid in a drilling fluid storage tank while pumping the drilling fluid into a wellbore from the tank and returning fluid from the wellbore into the tank or (ii) a rate of flow of fluid returning from the wellbore;

determining a rate at which fluid enters the wellbore by determining a change in either (i) the fluid level or (ii) the measured rate of flow of fluid returning from the wellbore;

switching control of discharged fluid returning from the wellbore to be substantially constant while reducing wellbore pressure when the determined rate is slowing; and switching control of discharged fluid returning from the wellbore to maintain a selected wellbore fluid pressure when a formation causing the entry of fluid into the wellbore becomes depleted.

7. The method of claim 6 wherein the control of fluid returning from the wellbore comprises operating a variable orifice choke in a discharge line from the wellbore.

8. The method of claim 6 further comprising measuring a flow rate of fluid into the wellbore.

9. The method of claim 8 wherein the measuring the flow rate of fluid into the wellbore and returning from the wellbore comprises detecting at least one of constant volume and decreasing volume of fluid stored in a supply/return tank.

10. The method of claim 6 wherein switching control to maintain a selected wellbore pressure is performed when a variable orifice choke is substantially completely opened.

11. An apparatus, comprising:

a fluid level sensor functionally coupled to a fluid storage tank;

a flow rate sensor functionally coupled to a pump, the pump functionally coupled at an intake to the fluid storage tank and at an outlet to a conduit disposed in a wellbore;

a pressure sensor functionally coupled to a fluid outlet from the wellbore;

a controllable flow restriction disposed in the fluid outlet; and a controller in signal communication with the fluid level sensor, the flow rate sensor and the pressure sensor, the controller having instructions programmed therein to cause operation of the controllable flow restriction to: (i) maintain a substantially constant fluid level in the tank while reducing pressure in the fluid outlet after detection of an increase in the level thereof and subsequent slowing of a rate of the increase; and (ii) maintaining a substantially constant pressure in the fluid outlet when the rate of increase drops below a selected amount.

12. The apparatus of claim 11 further comprising a flow meter functionally coupled to the outlet of the pump, and wherein the controller comprises instructions to cause the operation of the controllable flow restriction in response to a difference between a measured fluid low rate into the wellbore and a measured fluid flow returning from the wellbore.

13. The apparatus of claim 11 wherein the controllable flow restriction comprises an adjustable orifice choke.

14. The apparatus of claim 11 wherein the conduit comprises a drill pipe.

15. The apparatus of claim 11 further comprising a rotating control head disposed at a top of the wellbore, the rotating control head sealing an annular space between the wellbore and the conduit therein, the rotating control head having a fluid outlet in fluid communication with the annular space and in fluid communication with the fluid outlet.

* * * * *